United States Patent [19]

Robinson

[11] Patent Number: 4,457,832

[45] Date of Patent: Jul. 3, 1984

[54] COMBINATION CATALYTIC REFORMING-ISOMERIZATION PROCESS FOR UPGRADING NAPHTHA

[75] Inventor: Richard C. Robinson, San Rafael, Calif.

[73] Assignee: Chevron Research Company, San Francisco, Calif.

[21] Appl. No.: 558,574

[22] Filed: Dec. 6, 1983

Related U.S. Application Data

[63] Continuation of Ser. No. 459,147, Jan. 19, 1983, abandoned.

[51] Int. Cl.[3] ..... C10G 35/04

[52] U.S. Cl. ..... 208/66; 208/64; 208/135; 585/315

[58] Field of Search ..... 208/65, 66, 135, 64; 585/315

[56] References Cited

U.S. PATENT DOCUMENTS 2,958,644 11/1960 Kimberlin et al. ..... 208/111

*Primary Examiner*—Curtis R. Davis

*Attorney, Agent, or Firm*—Burns, Doane, Swecker & Mathis

[57] ABSTRACT

A reforming-isomerization process for realizing optimum upgrading of a naphtha feedstock is disclosed. The feedstock is reformed over a bimetallic catalyst and the reformate is separated into one or more gas fractions, a $C_5$–$C_6$ paraffin liquid fraction and a reformate liquid product. The $C_5$–$C_6$ fraction is isomerized to upgrade the $C_5$–$C_6$ components and the isomerizate is separate into a light gas product and a $C_5$–$C_6$ isomerizate liquid product with optional separation and recycle of normal paraffins. The light gas products are compressed and recycled for use in the reformation and isomerization. The $C_5$–$C_6$ isomerizate is blended with the reformate liquid product to produce high octane motor fuel.

8 Claims, 2 Drawing Figures

COMBINATION CATALYTIC REFORMING-ISOMERIZATION PROCESS FOR UPGRADING NAPHTHA

This application is a continuation, of application Ser. No. 459,147, filed Jan. 19, 1983 abandoned.

BACKGROUND OF THE INVENTION

1. Field of the Invention

The invention relates to a combination reforming-isomerization process for upgrading naphtha feedstocks.

2. Description of the Prior Art

Catalytic reforming of naphtha converts low octane components of the naphtha into higher octane compounds by a combination of dehydrogenation, dehydrocyclization, and isomerization. Such conversion to increase octane rating is commonly called "upgrading". One of the undesirable side reactions of catalytic reforming is cracking of high boiling components of the naphtha into low octane $C_5$ and $C_6$ hydrocarbons. The presence of such low octane hydrocarbons lowers the overall octane rating of the reformate. This situation has been remedied by separating the $C_5$ and $C_6$ component of the reformate and subjecting it to a separate isomerization. Processes that involve separate reforming and isomerization are called "combination" processes.

The patent literature describes several combination reforming-isomerization processes. U.S. Pat. No. 2,263,026 describes a combination process in which a heavy straight run naphtha is vaporized and fed to a dehydrogenation reactor at 750° F. to 900° F. where the saturated paraffins in the naphtha are converted to olefins and aromatics. The dehydrogenated naphtha is then fed to an isomerization reactor at 600° F. to 750° F. where the olefins are converted into branched or cyclic isomers.

U.S. Pat. No. 2,946,736 teaches a process for upgrading a full boiling naphtha in which the naphtha is first fractionated into a 180° F.− fraction and a 180° F.+ fraction. The 180° F.+ fraction is catalytically reformed and the components of the reformate boiling below 180° F. are removed from the reformate. The two 180° F.− fractions—the one from the naphtha feed and the one from the reformate—are combined and the n-$C_5$ and n-$C_6$ are removed from the combined 180° F.− fractions. The n-$C_5$ and n-$C_6$ are then upgraded by isomerization.

U.S. Pat. No. 3,287,253 describes a three-stage naphtha reforming process in which each stage involves a different catalyst that selectively promotes one or more reforming reactions. The first stage promotes dehydrogenation of naphthenes. The second promotes dehydrogenation of naphthenes and isomerization of straight chain and cyclic paraffins. The third stage promotes dehydrocyclization of paraffins.

U.S. Pat. No. 3,502,570 teaches a process in which naphtha is first subjected to a sulfur-modified reforming process. The reformate is then fractionated into four fractions: $C_1$–$C_4$; $C_5$–$C_6$; $C_7$; and $C_8$+. The $C_5$–$C_6$ fraction is isomerized and the isomerizate is blended with the $C_8$+ fraction.

SUMMARY OF THE INVENTION

The invention is a process for upgrading a naphtha feedstock comprising:

(a) catalytically reforming the naphtha feedstock;

(b) separating the reformate into one or more gas fractions which combined comprise hydrogen and $C_1$–$C_4$ hydrocarbons, a $C_5$–$C_6$ paraffin-rich liquid fraction, and a liquid residual fraction;

(c) catalytically isomerizing the $C_5$–$C_6$ paraffin-rich liquid fraction; and (d) fractionating the isomerized $C_5$–$C_6$ paraffin-rich liquid fraction into a light gas product and an isomerizate liquid product fraction comprising $C_5$–$C_6$ hydrocarbons.

BRIEF DESCRIPTION OF THE DRAWINGS

In the drawings.

Like elements are referred to by the same reference numerals in the drawings.

DETAILED DESCRIPTION OF THE INVENTION

Unless indicated otherwise boiling points are specified at 760 mm Hg pressure.

The naphtha feedstock to the invention process is preferably a full boiling naphtha. Such feedstocks typically have a boiling range of about 50° F. to about 450° F. Alternatively the feedstock may be a naphtha cut with a limited boiling range such as a $C_6$-depleted feedstock that boils in the range of 180° F. to 400° F. Examples of naphtha feedstocks that may be upgraded by the process are straight-run naphthas, coker naphthas, hydrocracked naphthas, thermally cracked or catalytically cracked naphthas, or blends thereof.

Figure 1:
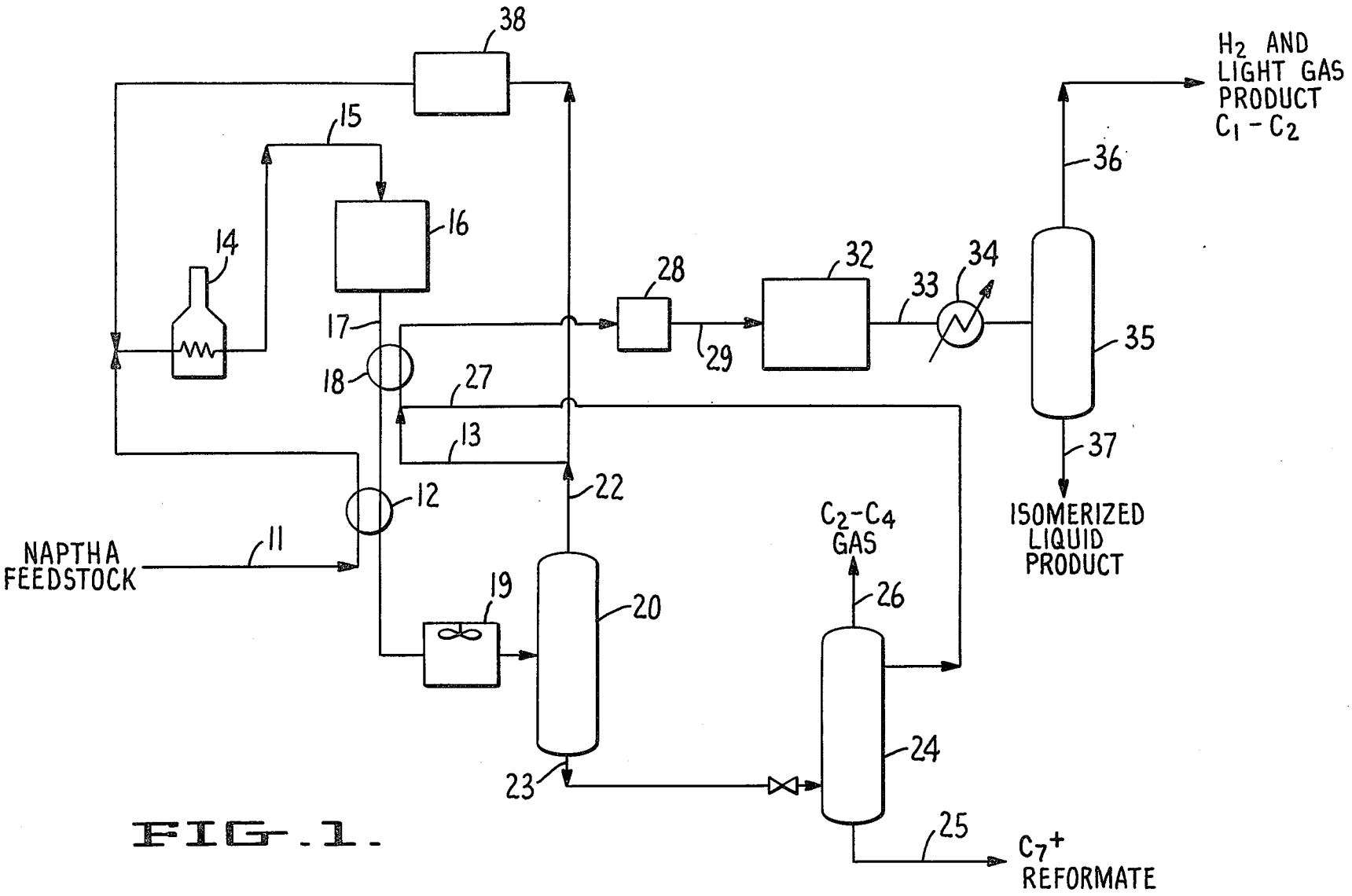
FIG. 1 is a schematic flow diagram that illustrates one embodiment of the process.

Referring to FIG. 1, the naphtha feedstock is fed via line 11 to a feed-reformer effluent heat exchanger 12 where it is partially heated to reforming temperatures. The partially heated feedstock is then combined with recycle gas comprising hydrogen and light ($C_1$–$C_2$) hydrocarbon gases from recycle gas line 13 and the combined mixture is fed to furnace 14 where it is further heated to reforming temperatures. The recycle gas will typically be mixed with the liquid feedstock in proportions in the range of about three to about ten moles gas per mole of feedstock. The temperature of the feed to furnace 14 will usually be between about 500° F. and 800° F.; whereas the temperature of the heated effluent will usually range between 850° F. and 1050° F. The effluent leaves the furnace via line 15 and is carried thereby to reforming zone 16. The reforming zone will physically comprise reforming reactors that contain one or more reforming catalysts. Usually the reforming will be done in stages and, accordingly, the zone will comprise three or four reactors.

The reforming catalyst will generally comprise a catalytically active amount of a platinum group component supported on a refractory porous carrier or base such as high purity alumina. The catalyst will also preferably include a promoter that enhances the activity, fouling rate, stability and/or selectivity of the catalyst. The promoting agents normally employed are metals such as rhenium, germanium, and technetium. Reforming catalysts that contain such promoter metals are commonly called "bimetallic catalysts." The platinum group component will usually comprise from 0.01% to 2%, more usually 0.1% to 1%, by weight calculated as metal and based on the finished catalyst. The promoter will usually be present in like proportions also calculated as metal and based on the finished catalyst. The finished catalyst also contains chloride from 0.1% to 2% by weight based on the finished catalyst.

The reformers will typically be operated at temperatures approximating the furnace effluent temperatures stated above and pressures in the range of about 25 to about 500 psig, preferably 50 to 300 psig, when a bimetallic catalyst is used. The temperature and pressure are correlated with liquid hourly space velocity (LHSV), e.g., volumes of liquid feed per hour processed per volume of catalyst, to provide the desired type of reforming (dehydrocyclization, isomerization, and/or dehydrogenation). Generally the LHSV will be between about 0.1 and about 10 and more usually between 1 and 5.

The reformate is withdrawn from the reforming zone through line 17 and portions of the heat content thereof are exchanged to the isomerization feed (described below) and to the naphtha feedstock in exchangers 18 and 12. The reformate is typically cooled to about 200° F. to 400° F. by such exchange. After the heat exchange the cooled reformate is further cooled in an exchanger 19 and then passed to a high pressure separation zone 20 where hydrogen-rich vapors are removed overhead for recycle via line 22 and a $C_4$+ hydrocarbon product is taken off as a bottoms liquid via line 23. The liquid stream is passed to a reformate splitter column 24 where its pressure is reduced to about 15 to 150 psig to cause it to be fractionated into a $C_2$–$C_4$ light hydrocarbon vapors product, a $C_5$–$C_6$ paraffin rich fraction, and $C_7$+ residual liquid product. The residual liquid product is taken off as bottoms from the separator via line 25 and the light hydrocarbon vapors are withdrawn overhead through line 26. The $C_5$–$C_6$ cut is removed from the splitter by line 27 combined with a portion of the $H_2$ rich recycle gas stream, 13, and then heated, typically to 300° F. to 600° F., by exchange in exchanger 18 with the reformer effluent. The heated $C_5$–$C_6$ stream is then carried to a compressor 28 where it is compressed to about 200 to 600 psig. The compressed vapors are discharged from the compressor into line 29 which transports them to an isomerization zone 32.

The isomerization conditions and catalyst are selected to effect substantial octane upgrading of $C_5$–$C_6$ hydrocarbons. In this regard some isomerization of $C_5$–$C_6$ hydrocarbons (either those contained in the naphtha feedstock and/or those produced via cracking in the reforming zone) normally occurs in the reforming zone. However, the reforming conditions and catalyst are not optimal for effecting such isomerization and $C_5$–$C_6$s are thus only partially upgraded. Accordingly, normal $C_5$–$C_6$s constitute a substantial portion of the feed to the isomerization. More particularly the isomerization feed will usually have the following composition.

| Component | Mol % |
|---|---|
| $H_2$ | 50–90 |
| $C_1$–$C_3$ | 5–20 |
| n-$C_4$ | 1–5 |
| i-$C_4$ | 1–5 |
| n-$C_5$ | 1–5 |
| i-$C_5$ | 1–5 |
| cyclo $C_5$ | 0–1 |
| n-$C_6$ | 1–5 |
| i-$C_6$ | 1–5 |
| cyclo $C_6$ | 0–1 |

The isomerization will usually be run at temperatures in the range of 300° F. to 600° F., preferably 350° F. to 500° F. and pressures in the range of 200 to 600 psig, preferably 300 to 500 psig. The isomerization catalyst will typically be a Group VIII metal on an absorptive carrier promoted by halogen or boron. Platinum on an alumina carrier promoted with a chloride is a particularly preferred isomerization catalyst.

The isomerization causes substantial octane upgrading of the $C_5$–$C_6$ components by converting the n $C_4$–$C_6$s into branched or cyclic isomers. More particularly the isomerizate will typically have the following composition:

| Component | Mol % |
|---|---|
| $H_2$ | 50–90 |
| $C_1$–$C_3$ | 5–20 |
| n $C_4$ | 0–3 |
| i-$C_4$ | 2–10 |
| n $C_5$ | 0–3 |
| i-$C_5$ | 2–10 |
| cyclo $C_5$ | 0–1 |
| n $C_6$ | 0–3 |
| i-$C_6$ | 2–10 |
| cyclo $C_6$ | 0–1 |

The isomerizate leaves the isomerization zone through line 33 and is transported thereby through a heat exchanger 34 where it is cooled to about 50° F. to 150° F. After it is cooled the isomerizate is passed to a high pressure separation zone 35 where it is separated into a vapor product comprising $H_2$ and $C_1$–$C_2$s and a liquid isomerizate product comprising the $C_5$–$C_6$s. The vapor product is taken overhead from the zone via line 36 whereas the $C_5$–$C_6$ product is withdrawn as bottoms via line 37. A portion of the vapor product is recycled to the reformer via line 13 as described above.

The two liquid products from the combined reforming-isomerizing process depicted in FIG. 1—the $C_7$+ product and $C_5$–$C_6$ product—may be blended to produce high octane motor fuel.

Figure 2:
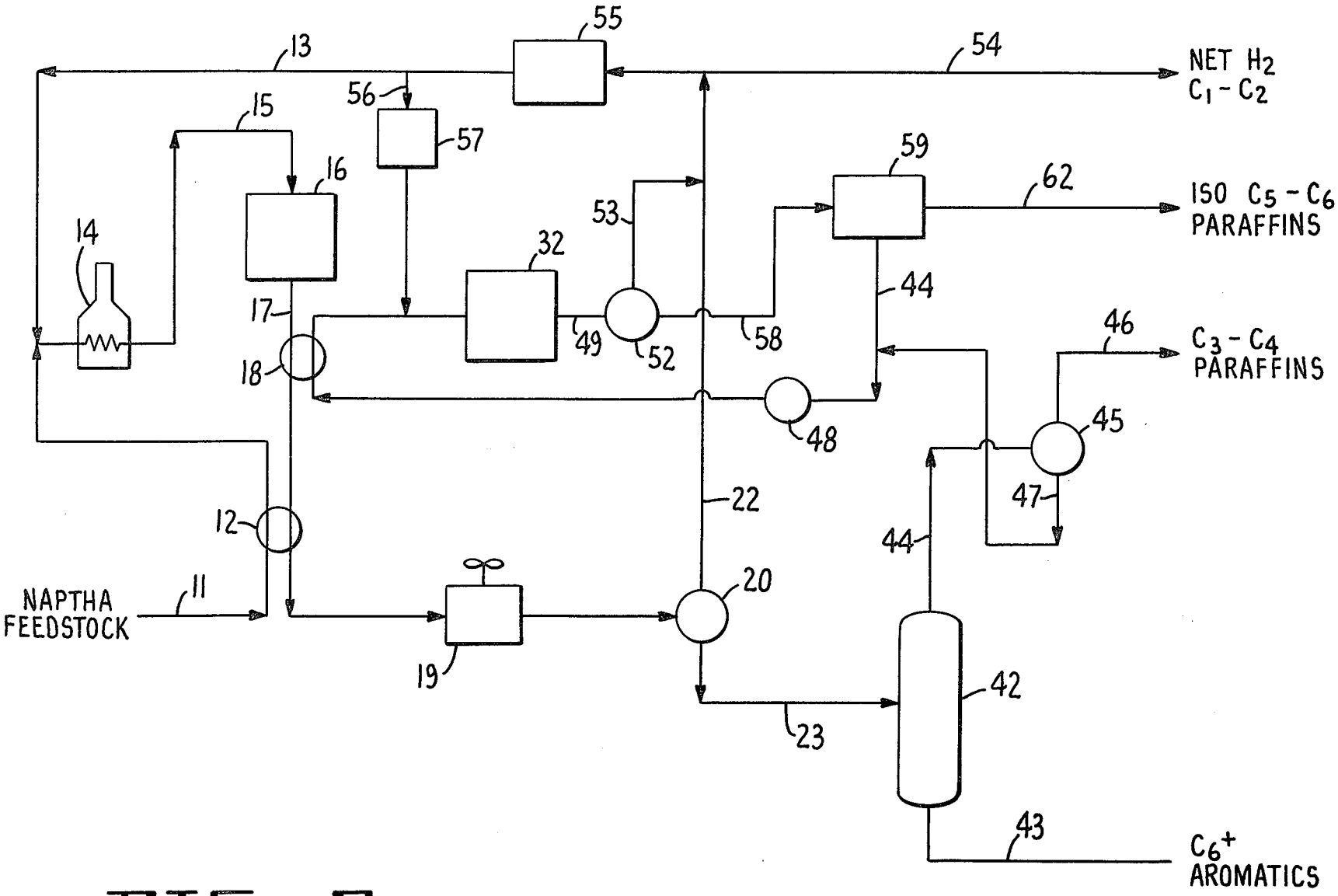
FIG. 2 is a schematic flow diagram that illustrates a second, more preferred embodiment of the invention.

FIG. 2 shows a more efficient variation of the process depicted in FIG. 1. In the variation the naphtha feedstock is heated and reformed and the reformate cooled and separated into a $H_2$-rich recycle and $C_4$+ liquid stream. The liquid stream is carried to a fractionation column 42 where it fractionated into a $C_3$–$C_6$ paraffins overhead stream and a $C_6$ aromatics+liquid reformate product. The $C_6$ aromatics+stream is taken off as bottoms via line 43. The overhead is taken off by line 44 and carried to an overhead separator 45 where the $C_3$–$C_4$ paraffins are separated from the $C_5$–$C_6$ paraffins. The $C_3$–$C_4$ product is taken off via line 46. The $C_5$–$C_6$s are removed from the separator by line 47 combined with recycled normal paraffins 44 and the $H_2$ rich stream 56 and carried thereby through a compressor 48, exchanger 18 to the isomerization reactor 32. The isomerization conditions are as described with respect to the process of FIG. 1. The isomerizate leaves the reactor via line 49 and passes through a separator 52 where hydrogen and $C_1$–$C_2$ gases are removed therefrom. The light gases are carried from the separator by line 53 and combined with the light gases from separator 20. Some of the combined light gases are drawn off as a net light gas product via line 54, whereas the remainder is passed through a recycle compressor 55. The compressed recycle vapors are split with some being recycled to the reformer furnace and some being carried by line 56 through a booster compressor 57 and mixed with $C_5$–$C_6$ feed to the isomerization reactor.

The liquid stream from separator 52 is carried via line 58 to a molecular seive separator 59 where the normal $C_5$–$C_6$ paraffins are separated from the iso $C_5$–$C_6$ paraffins. The normal paraffins are withdrawn from the separator by line 44 and recycled into the $C_5$–$C_6$ paraffin isomerization feed from separator 45. The iso $C_5$–$C_6$ paraffins are taken from the molecular seive separator by line 62. They may be blended with the reformate liquid product to produce a high octane motor fuel.

As shown above this process may be used to reform and isomerize a full boiling naphtha using catalysts and conditions that optimize reforming of the $C_5$+ fraction and isomerization of the $C_5$–$C_6$ components of the reformate. This process realizes significant savings in heat exchanger, compressor, and furnace capacity and produces a product having an octane rating significantly higher than the rating of a feedstock subjected only to reforming. Also, since the $C_5$–$C_6$ components are isomerized after reforming the naphtha feedstock may include more $C_5$–$C_6$ components than is usually feasible. Other advantages of combination reforming isomerization process are:

1. Improved front end octane of the gasoline blend due to upgrading in the isomerization zone.
2. Decreased octane sensitivity RON-MON which can effect engine performance.
3. Decreased severity of catalytic reformer and therefore better overall yield for combination process.
4. Overall better yield of product vs octane number RON or MON or (R+M/2) on that product.

Modifications of the above described embodiments of the invention that are obvious to those of ordinary skill in the petroleum refining art are intended to be within the scope of the following claims.

I claim:

1. A combination process for upgrading a naphtha feedstock comprising:

(a) catalytically reforming the naphtha feedstock;

(b) separating the reformate into one or more gas fractions which combined comprise hydrogen and $C_1$–$C_4$ hydrocarbons, a $C_5$–$C_6$ paraffin-rich liquid fraction, and a liquid residual fraction;

(c) catalytically isomerizing the $C_5$–$C_6$ paraffin-rich liquid fraction; and (d) separating the isomerized $C_5$–$C_6$ paraffin-rich liquid fraction into a light gas product fraction and an isomerization liquid product fraction comprising $C_5$–$C_6$ hydrocarbons.

2. The combination process of claim 1 wherein step (b) is carried out in two substeps:

(i) separating the reformate into a hydrogen-rich gas fraction containing a major proportion of $C_1$ and $C_2$ hydrocarbons and a liquid product fraction, and (ii) splitting the liquid product into a $C_3$–$C_4$ gas fraction, said $C_5$–$C_6$ paraffin-rich liquid fraction and said liquid residual fraction.

3. The combination process of claim 1 wherein step (b) is carried out in three substeps:

(i) separating the reformate into a hydrogen-rich gas fraction containing a major proportion of $C_1$ and $C_2$ hydrocarbons and a liquid product fraction;

(ii) fractionating the liquid product fraction into a $C_3$–$C_6$ fraction and said liquid residual fraction; and (iii) separating the $C_3$–$C_6$ fraction into a $C_3$–$C_4$ fraction and said $C_5$–$C_6$ paraffin-rich liquid fraction.

4. The process of claim 2 wherein the hydrogen-rich gas fraction and the light gas product fraction are combined and at least a portion thereof is recycled for use in the feedstock reforming.

5. The process of claim 3 wherein the hydrogen-rich gas fraction and the light gas product fraction are combined and at least a portion thereof is recycled for use in the feedstock reforming.

6. The process of claim 1 wherein at least a portion of said gas fraction fractions and at least a portion of the light gas product fraction are recycled for use in the feedstock reforming.

7. The process of claim 1 wherein the normal $C_5$–$C_6$ hydrocarbons are separated from the isomerizate liquid product fraction and recycled to the isomerization reaction.

8. The process of claim 1 including the step of (e) blending the isomerizate liquid product fraction with the liquid residual fraction.

* * * * *